US005388789A

United States Patent [19]

Rudershausen

[11] Patent Number: 5,388,789

[45] Date of Patent: Feb. 14, 1995

[54] SYSTEM FOR SAFELY AND AUTOMATICALLY CONTROLLING THE DISTANCE BETWEEN VEHICLES

[75] Inventor: Reinhart Rudershausen, Ammersee, Germany

[73] Assignee: AEG Monorail Systems Inc., Wilmington, Del.

[21] Appl. No.: 985,482

[22] Filed: Dec. 4, 1992

[30] Foreign Application Priority Data

Dec. 6, 1991 [CH] Switzerland ..... 03597/91

[51] Int. Cl.[6] ..... B61L 3/00

[52] U.S. Cl. ..... 246/167 D; 246/182 R; 246/182 B; 246/182 C

[58] Field of Search ..... 246/25, 33 R, 46, 47, 246/64, 65, 86, 182 R, 182 A, 182 B, 167 D, 167 M, 167 R; 104/299, 300, 301

[56] References Cited

U.S. PATENT DOCUMENTS

| | | | |
|---|---|---|---|
| 3,817,344 | 6/1974 | Asano et al. | 246/167 D |
| 3,835,950 | 9/1974 | Asano et al. | 246/167 D |
| 4,133,505 | 1/1979 | Bongiorno | 246/167 D |
| 4,956,779 | 9/1990 | Rutherford | 364/426.05 |

FOREIGN PATENT DOCUMENTS

| | | | |
|---|---|---|---|
| 1291765 | 4/1969 | Germany | 246/167 D |
| 2215666 | 10/1973 | Germany . | |
| 2948384 | 6/1981 | Germany . | |
| 397761 | 2/1966 | Switzerland . | |
| 426923 | 6/1966 | Switzerland . | |
| 554253 | 9/1974 | Switzerland . | |

OTHER PUBLICATIONS

Wampfler, Anti-Collision Device No. 80230, 1990.

*Primary Examiner*—Mark T. Le

*Attorney, Agent, or Firm*—Cushman, Darby & Cushman

[57] ABSTRACT

The present invention provides a system for automatically controlling the distance between vehicles following each other on the same drive track which includes in each vehicle a drive device, brake device, distance sensing device, vehicle speed measuring device, and control device. Paralleling the drive track are a neutral rail and a control rail. The drive device drives the vehicle. The brake device brakes the vehicle. The distance sensing device generates a distance variable. The vehicle speed measuring device measures a speed of the vehicle, and generates speed signals based thereon. The control device controls the drive device to drive the vehicle at a speed based on a speed control variable. The control device generates the speed control variable based on the distance variable. The speed control variable is less than the distance variable. The control device also controls the brake device to brake the vehicle when a speed signal is greater than a maximum permissible speed; the maximum permissible speed being dependent on the distance variable.

20 Claims, 3 Drawing Sheets

SYSTEM FOR SAFELY AND AUTOMATICALLY CONTROLLING THE DISTANCE BETWEEN VEHICLES

BACKGROUND OF THE INVENTION

1. Field of the Invention

The present invention relates to a system for automatically controlling the distance between vehicles on the same track.

2. Description of Related Art

A conventional system for automatically controlling the distance between vehicles is disclosed in CH-A-426 923. A drive device and a control device with three parallel branches is present on each vehicle. The first branch has a DC voltage source with a series-connected working resistor, the second branch has an engine controller for controlling the drive device and the third branch has a monitoring device.

These branches are connected via a first rear sliding contact to a neutral rail running parallel to the carriageway of the vehicles. The branches are also connected via a further sliding contact, which when viewed in the direction of travel is at the front of the vehicle, to a control rail also running parallel to the carriageway.

The control rail is short-circuited to the neutral rail via a third, sliding contact at the rear of each vehicle. The control rail is divided into equally long sections whose length is shorter than the spacing between the front and rear sliding contact of a vehicle.

Between every two successive sections is connected a diode whose conducting direction corresponds to the direction of travel. These diodes form, together with the control rail, a recurrent network.

A positive voltage generated by the voltage source is applied via the corresponding front sliding contact to the control rail. This voltage drops in a step-like manner along the control rail as a result of the short circuit between the control rail and the neutral rail at the rear end of the vehicle in front. The voltage between the front sliding contact and the neutral rail is a distance variable, and thus indicates the distance from a vehicle in front.

The engine controller controls the speed of the vehicle as a function of this distance variable. The greater the distance to the vehicle in front, the higher the voltage which indicates the distance variable. When the distance between vehicles is large, the distance variable is at a maximum value and the engine controller controls the drive device to the highest permissible travel speed. The lower limit of the control range is at a distance variable which corresponds to the spacing between several sections of the control rail. At this lower limit the vehicle is brought to a complete standstill by braking.

The voltage source is periodically and briefly connected with reversed polarity to the control rail. The monitoring device then tests the voltage between the front and rear sliding contact of a vehicle and triggers emergency braking when this voltage deviates from a set value. As a result, a collision with a moving or stationary vehicle is prevented in the event of faults occurring in a diode of the recurrent network, a broken connection between two diodes, a broken contact to one of the sliding contacts, or other faults which result in failure of the automatic control.

The authorized safety control systems known hitherto for automatic or driverless operation are based either on block systems, as in the case of conventional interlocking control technology; or on vital control computers which are installed at the side of the rail route, receive vital position information from vital vehicle computers, and thus vitally control an "electrical sight running system". In this context, vital implies that the systems themselves detect faults and bring about a safe vehicle status when a fault is detected. In railway signalling technology vital includes the connotations of "fail-safe" and "checked-redundant".

Block systems operate with a rough subdivision of the track into so-called block sections. Systems of this kind are designed so that a train travelling through a block section leaves behind one to two items of safety information. The safety information has a low degree of differentiation, for example in the form of signal positions at red or green, for securing the block on the section of rail. Here, it is disadvantageous that a following train may have to constantly change its speed as a function of the block length, and may unnecessarily have to stop. The entire expenditure in terms of material of a block section control of this design is so high that finer sub-divisions of the block sections is too costly.

Another solution which has been devised more recently using reliable vehicle-side or rail route-side computers requires a costly hazards analysis and safety certification of complex software in multi-channel redundant structures.

SUMMARY OF THE INVENTION

An object of the present invention is to provide a system for automatically controlling the distance between vehicles on the same track which is free of the disadvantages of conventional systems, is vital in terms of signalling technology, and is cost efficient.

To achieve the above and other objects, the present invention provides a system for automatically controlling the distance between vehicles following each other on the same drive track which includes in each vehicle a drive means, brake means, distance sensing means, vehicle speed measuring means, and control means. Paralleling the drive track are a neutral rail and a control rail. The drive means drives the vehicle. The brake means brakes the vehicle. The distance sensing means generates a distance variable. The vehicle speed measuring means measures a speed of the vehicle, and generates speed signals based thereon. The control means controls the drive means to drive the vehicle at a speed based on a signal representing speed control, herein referred to as the speed control variable. The control means generates the speed control variable based on the signal representing the distance from a vehicle in front, or more simply the distance variable. The speed control variable is less than the distance variable. The control means also controls the brake means to brake the vehicle when a speed signal is greater than a maximum permissible speed; the maximum permissible speed being dependent on the distance variable.

In the event of failure of components relevant for safety, emergency braking is applied and collision between vehicles or running into an open set of points or travelling beyond the end of the track is prevented. A "point" is a rail switch. Therefore, an open set of points is where the tongue or frog (the moveable part of the rail switch) is not aligned in one or the other of the (normally) two alternative connecting positions. Additionally, a tongue or frog which is not locked in a connecting position can be considered an open point.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various features.

DETAILED DESCRIPTION OF THE PREFERRED EMBODIMENTS

Figure 1:
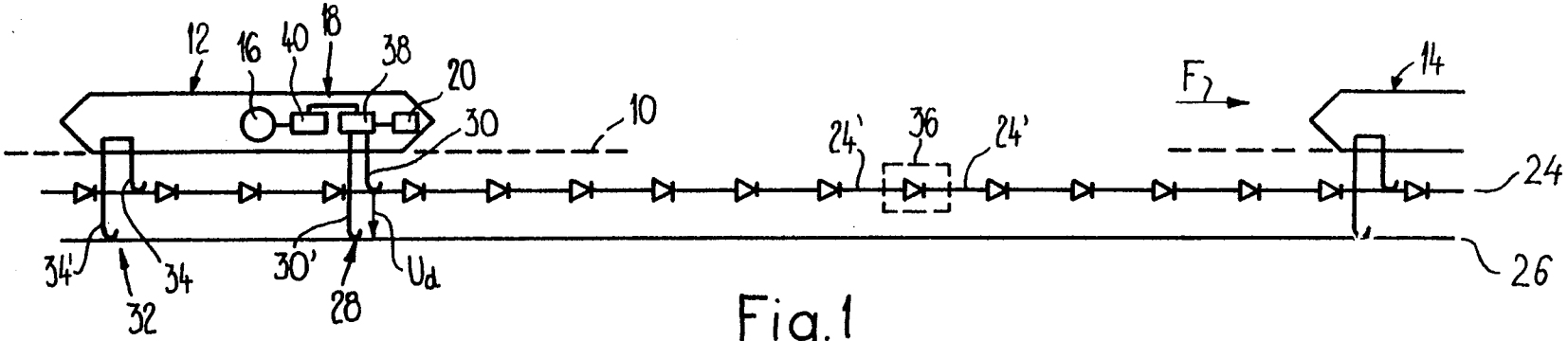
FIG. 1 is a schematic view of a system for automatically controlling the distance between vehicles on the same track according to the present invention.

FIG. 1 shows a first vehicle 12 travelling on a track 10, indicated by dot-dash lines, in the direction of travel F and a second vehicle 14 (only partially illustrated) which is travelling ahead on the same track 10. Each vehicle 12, 14 has a generally known drive device 16 and a mechanical emergency brake 20. Each vehicle 12, 14 also has a control device 18. A speed measuring device 22 (indicated diagrammatically in FIG. 3) is provided on each vehicle 12, 14 (not shown in FIG. 1). The vehicles 12, 14 are of identical design. However, for clarity the above mentioned devices are indicated only in the first vehicle 12.

A control rail 24 and a neutral rail 26, which preferably conducts ground potential, run parallel to the track 10. Viewed in the direction of travel F, each vehicle 12, 14 has a front sensing device 28 with pick-up shoes 30, 30'. Pick-up shoes 30', 30 in contact with neutral rail 26 and control rail 24, respectively, connect the control rail 24 and neutral rail 26 to the control device 18. Viewed in the direction of travel F, each vehicle 12, 14 also has a rear sensing device 32 with pick-up shoes 34, 34' for short-circuiting the control rail 24 to the neutral rail 26.

The control rail 24 is divided as indicated in FIG. 1, into mutually insulated sections 24' of the same length. The length of a section 24' is less than the distance between the front and rear sensing device 28, 32 of the vehicles 12, 14. Preferably, each section 24' is three to four times shorter than the distance between the sensing devices 28, 32. A diode block 36 is connected between every two sections 24'.

For the sake of simplicity diode block 36 is illustrated as a diode in FIG. 1. The diode blocks 36 have a conducting direction corresponding to the direction of travel F. The sections 24' and the diode blocks 36 thus form a recurrent network.

A control component 38 of the control device 18 is connected to the front sensing device 28 and to the emergency brake 20. Furthermore, the control component 38 is connected to the drive control unit 40 which, as described in detail below, controls the travel speed of the control device 18 in an open-loop and closed-loop manner.

Figure 3:
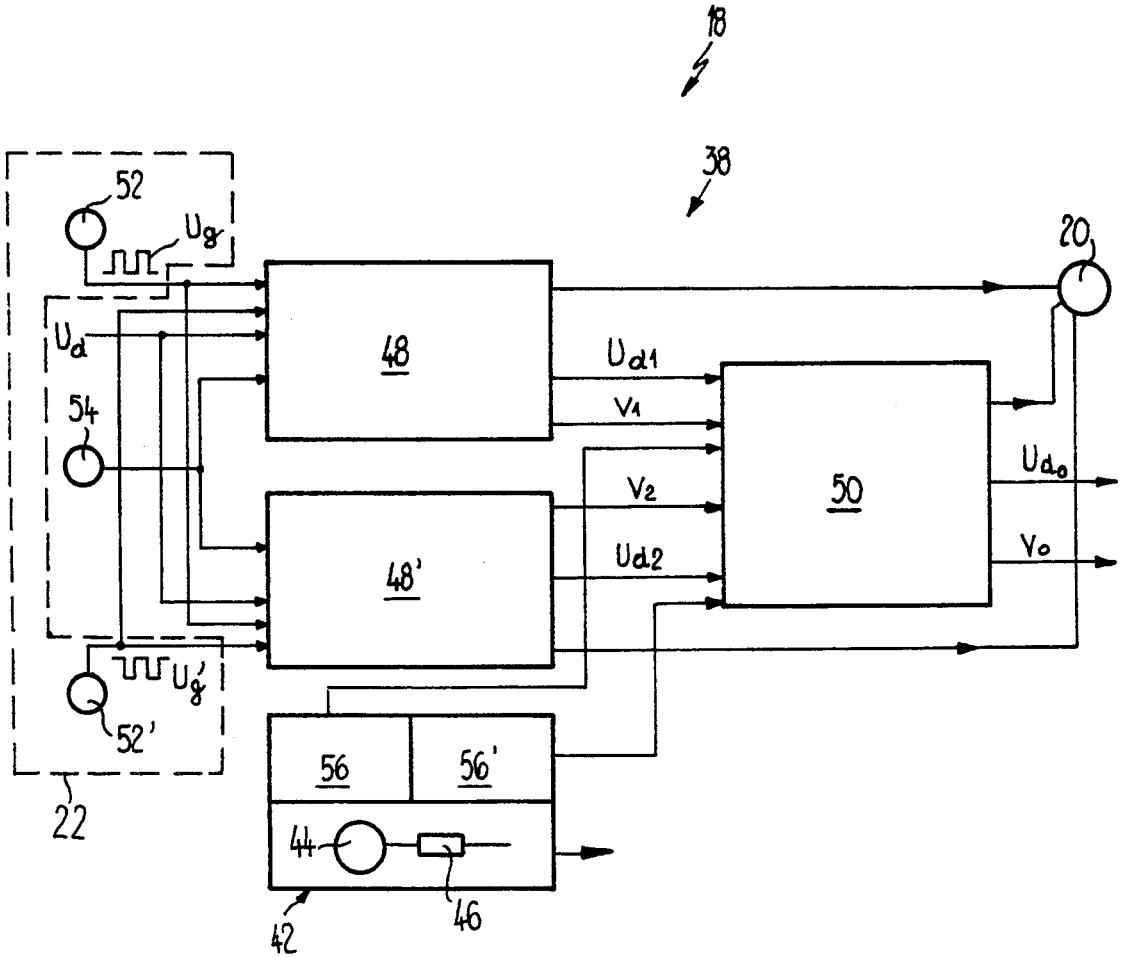
FIG. 3 is a block diagram of the control device of a vehicle according to FIG. 1.

In FIG. 3, the control component 38 of the control device 18 is shown in greater detail. The control component 38 has a voltage source unit 42. The voltage source unit 42 includes a voltage source 44, which preferably generates a DC voltage, and a working resistor 46 connected in series thereto. The negative terminal of the voltage source 44 is connected via the pick-up shoe 30' to the neutral rail 26, and the positive terminal is connected to the control rail 24 via the working resistor 46 and the pick-up shoe 30.

Figure 2:
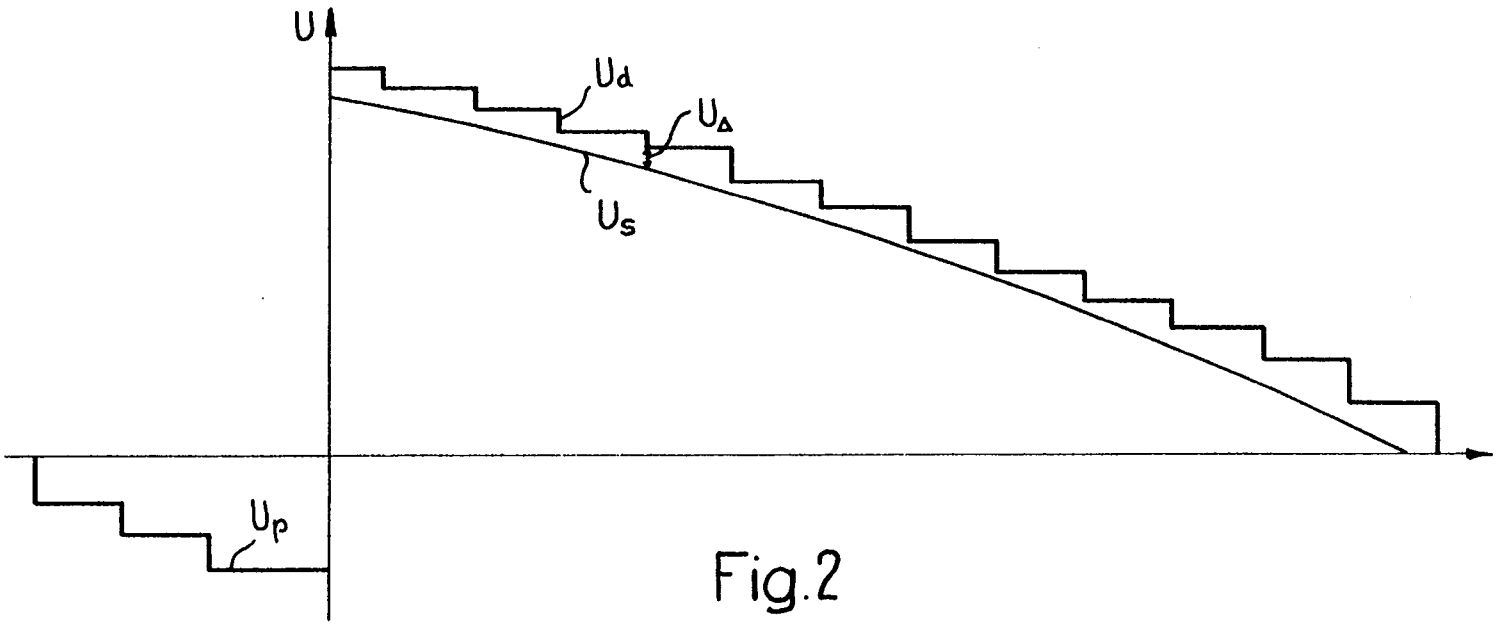
FIG. 2 is a graph of the characteristic of the distance variable along the recurrent network according to FIG. 1 and a speed control variable, derived from the distance variable, for controlling the drive device of a respective vehicle.

The voltage generated by the voltage source unit 42 drops along the control rail 24 in a step-like manner via the diode blocks 36 between the front sensing device 28 of the first vehicle 12 and the rear sensing device 32 of the second vehicle 14, as shown by FIG. 2. An unequal gradation of the voltage increments can be achieved by diode blocks 36. The polarity of the diode blocks 36 prevents the current in the control rail 24 from flowing from the front sensing device 28 to the rear sensing device 32 of the same vehicle. The voltage Ud which is tapped off via the recurrent network, i.e. the control rail 24 and neutral rail 26 by front sensing device 28 is thus a distance variable which constitutes a measure of the distance between the vehicle 12 and the vehicle 14 travelling in front. When the distance is large, the distance variable Ud is larger than when the distance between the two vehicles 12, 14 is small.

The distance variable Ud is, as described below, monitored and evaluated by the control component 38 and fed to the drive control unit 40. The drive control unit 40 according to generally known methods, smooth the step-like voltage jump when the pick-up shoe 30 travels onto a new section 24'. The drive control unit 40 also subtracts a voltage UΔ (indicated diagrammatically in FIG. 2) from the smoothed signal in order to generate a speed control variable Us. UΔ is a small amount, for example, 1 m/sec. The drive control unit 40 scans, at an appropriate frequency, the resulting lower step signal produced by the subtraction, and smooth the resulting lower step signal by limiting acceleration/deceleration to a present maximum value. Further smoothing can be achieved with known prediction algorithms, such as a Wiener Filter or a Kalman Filter. In FIG. 2, the speed control variable Us is shown as a function of the distance from the vehicle 14 travelling in front. The speed control variable is always smaller than the distance variable Ud. This speed control variable Us is a set value for the vehicle speed and is dependent on the distance between the vehicles 12, 14. The drive control unit 40 controls the travel speed according to this set value.

The polarity of the voltage source 44 is periodically reversed so that a step-like voltage drop occurs between the front and rear sensing device 28, 32 of the vehicle 12 via the diode blocks 36 on the control rail 24. This voltage drop Up (test voltage) shown in FIG. 2 should be constant when the recurrent network is intact. The control component 38 monitors the test voltage drop Up and initiates emergency braking when the test voltage Up falls below a first predetermined tolerance value. In this way, the diode blocks 36 passed by a vehicle 12, 14 are monitored. The frequency with which the polarity of the voltage source 44 is reversed is preferably selected such that the testing of a corresponding diode block 36 takes place repeatedly during one passage of a vehicle.

As FIG. 3 shows, the control component 38 has two mutually independent control units 48, 48' and a comparator unit 50 connected downstream thereof. The two control units 48, 48' are fed the distance variable Ud, which is generated and tapped off between the control rail 24 and the neutral rail 46. It is possible to tap off of the distance variable Ud via separate pick-up shoes to increase safety.

The speed measuring device 22 is provided with two mutually independent speed measuring units 52, 52' whose speed signals Ug and Ug', which correspond to the measured speed, are respectively fed to the control units 48, 48' via the corresponding lines (indicated diagrammatically in FIG. 3). The two speed measuring units 52, 52' have pulse generators which are offset with respect to one another by a specific amount so that the speed signals Ug, Ug' have a specific phase shift. Another method for speed measuring consists of two DC-tachometers with antivalent polarity. The polarity of one tachometer gives direction, and faults can be detected by adding the antivalent signals.

Each of the control units 48, 48' determines the current travelling speed of the vehicle 12 from the-frequency of the speed signals Ug, Ug' and the direction of travel from the phase shift of these signals. If the speed which is determined from the speed signal Ug in a control unit 48, 48' is greater than a first speed tolerance value with respect to the speed determined from the speed signal Ug' or if it is detected that a vehicle is travelling counter to the direction of travel F, the respective control unit 48, 48' triggers emergency braking symbolized in FIG. 3 by the arrow leading to the emergency brake 20.

A brake monitoring device 54 is provided as a supplementary device for monitoring the function of the brake elements, and also for supplying their status to the two control units 48, 48'.

The two control units 48, 48' compare, independently of one another, the signal representing the distance variable Ud with the signal representing speeds determined from the speed signals Ug, Ug' and initiate emergency braking when a predetermined relationship between the measured speed (a speed signal Ug, Ug') and the distance variable Ud exceeds a predetermined safety margin. In another embodiment the emergency braking is initiated when a speed signal Ug, Ug' exceeds a maximum permissible speed determined based on the distance control variable Ud.

The two control units 48, 48' output the distance variable Ud, designated in FIG. 3 by Ud1 and Ud2, to the comparator unit 50 where they are compared with one another. If distance variables Ud1 and Ud2 should differ by more than a predetermined distance tolerance value, the comparator unit 50 initiates emergency braking indicated in FIG. 3 by the arrow leading to the emergency brake 20. Furthermore, the control units 48, 48' output to the comparator unit 50 the signals v1, v2 corresponding to the speed determined from the speed signals Ug, Ug'. If the comparator unit 50 detects a difference between the speed signals v1 and v2 which exceeds a second predetermined speed tolerance value, emergency braking is triggered.

Furthermore, the voltage source unit 42 is monitored by two mutually independent voltage monitoring units 56, 56' which supply corresponding status signals, for example the voltage generated by the voltage source 44 and its polarization, to the comparator unit 50. If the comparator unit 50 detects a difference between the status signals generated by voltage monitoring units 56, 56', emergency braking is initiated.

If the conditions for triggering emergency braking are not fulfilled, the comparator unit 50 outputs the distance variable as a Signal UdO to the drive control unit 40. The drive control unit 40 utilizes the distance variable UdO, which is safe in terms of signalling technology, to control the speed of the drive device 16. The control unit 40 generates speed control variable Us by subtracting a variable UΔ from a smoothed version of signal UdO. All speeds below the speed control variable are permissible, however exceeding the maximum permissible speed leads to a safe emergency stop. The comparator also outputs a safety speed signal vO based on speed signals v1 and v2 which is used to unlock the doors when the vehicle is at a standstill.

Figure 4:
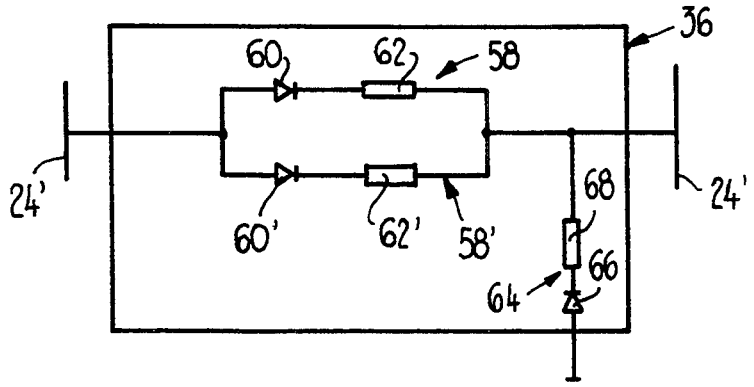
FIG. 4 is a preferred circuit of a diode block between the individual sections of the control rail and the neutral rail.

The diode blocks 36 are preferably designed as shown in FIG. 4. Between two adjoining sections 24', two diode elements 58, 58' are connected in parallel. Each diode element 58, 58' includes a diode 60, 60' connected in series to a resistor 62, 62'. Normally, the diode 60 is in operation and the control rail 24 can be configured by means of the respective resistor 62 to generate the desired voltage steps in the distance variable Ud. If, the diode 60 becomes defective, the diode 60' assumes the function. The respective resistor 62' is preferably selected so that a fault in the diode block 36 can be detected on the basis of the test voltage Up. The diode block 36 also has, viewed in the conducting direction of the diode elements 58, 58', a diode unit 64 which is connected downstream of the diode elements 58, 58'.

The diode unit 64 includes a Zener diode 66 connected in series to a resistor 68 and the neutral rail 26. The resistor 68 is also connected at one end to diode elements 58, 58'. Selection of the individual elements of the diode blocks 36 allows construction of rail sections with speed restrictions, and generation of a distance variable Ud in the control rail 24 in the region of these rail sections for restricting vehicle speed to a desired value. Furthermore diode blocks 36 allow the control device 18 to detect a break in the recurrent network in front of the vehicle 12, 14, as discussed below in connection with FIG. 5.

Figure 5:
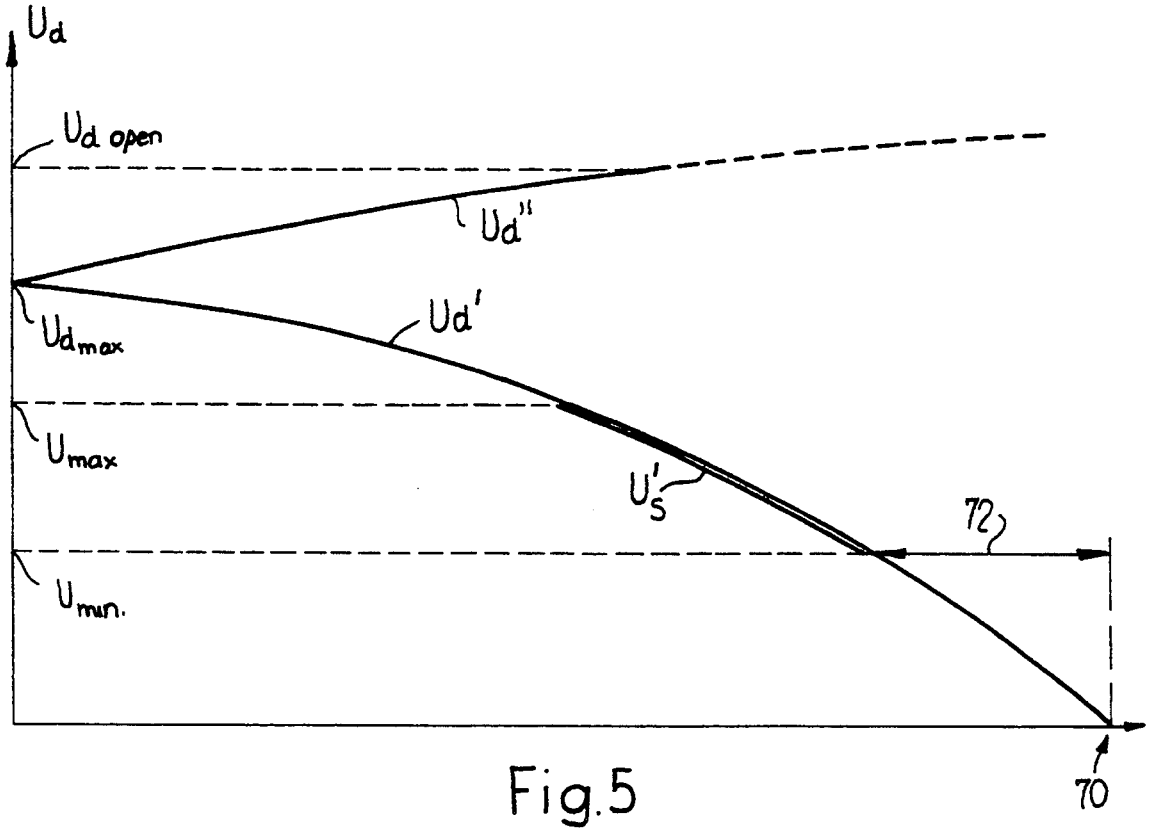
FIG. 5 is a graph of the characteristic of the distance variable when a short circuit occurs between the control rail and the neutral rail, and when there is a break in the recurrent network.

In the lower curve in FIG. 5, the characteristic of the distance variable Ud is shown for the case of a short-circuit between the neutral rail 26 and the control rail 24 at the point designated by the arrow 70; the curve Ud' being represented here as an approximation to the effective step curve shown in FIG. 2. In the upper curve Ud", the voltage characteristic of the distance variable Ud along the control rail 24 is approximately for the case of a break in the recurrent network in front of the vehicle.

Using the vehicle arrangement shown in FIG. 1 as an example, the short-circuit at 70 is generated either by means of the rear sensing device 32 of the second vehicle 14, (travelling or stationary), or by a connection between the control rail 24 and neutral rail 26 in front of vehicle 12. The drive control unit 40 of vehicle 12 controls the speed of the drive device 16, in the region between Umax and Umin of the measured distance variable Ud, in accordance with the speed control variable Us (cf FIG. 2) represented by Us' in FIG. 5.

The speed control variable Us is derived from the distance variable Ud and is always slightly below the currently maximum permissible speed given by a relationship to the distance variable Ud. If the speed control variable Us falls to or below the voltage Umin, the vehicle 12 is stopped. The vehicle 12 always stops in front of the short-circuit 70 at a distance designated in FIG. 5 by the double arrow 72. The control rail 24 is configured here in such a way that this distance 72 always includes several sections 24'. If the short-circuit 70 or the vehicle 14 travelling in front is at such a large distance from vehicle 12 that the speed control variable Us is greater than the voltage Umax, the drive control unit 40 adjusts the drive device 16 to a speed which corresponds to the maximum permissible speed. If the second vehicle 14 or short-circuit 70 is at a very large distance, the distance variable Ud corresponds to a value which is designated in FIG. 5 by Udmax and is given by the voltage division of the no-load voltage of the voltage source 44 by the working resistor 46 and the impedance of the recurrent network. If there is a break in the latter, the voltage Ud rises with respect to the value Udmax, as is shown by the upper curve Ud" in FIG. 5. The two control units 48, 48' (see FIG. 3) initiate emergency braking when the distance variable Ud exceeds a threshold value designated in FIG. 5 by Ud open.

The described open-loop control, closed-loop control, comparison and monitoring functions are carried out in the control device 18 with generally known switching arrangements in analog or digital technology. In the digital embodiment, analog signals, such as the distance variable Ud, are converted to digital signals by analog-to-digital convertors. The control device 18 can also have appropriately programmed microprocessors in order to assume the functions presented above. It is also conceivable for more than two control units to be connected in parallel and for the corresponding outputs thereof to be compared by more than one comparator unit to improve safety.

It is also conceivable to construct the control rail 24 as a continuous resistance element with impedance distributed uniformly over the length of the rail. It would also be conceivable to determine the distance and thus the distance variable between two successive vehicles 12, 14 with electromagnetic waves, microwaves, visible or infrared radiation or with sound waves or ultrasonic waves.

In all the embodiments, it is important that the distance variable corresponding to the distance between the vehicles 12, 14 be determined in a manner which is safe in terms of signalling technology and offers maximum reliability. It is equally necessary to determine the speed of the vehicles 12, 14 in a manner which is safe in terms of signalling technology and to compare and monitor these signals by means of a reliable control device 18.

Whenever points are changed at the open end of a respective track, the control rail 24 is preferably short-circuited to the neutral rail 26. This ensures that vehicles travelling towards the points stop a distance 72 (FIG. 5) in front of the points. At the end of the track, the control rail 24 is also preferably short-circuited to the neutral rail 26 to prevent the vehicles 12, 14 from overshooting the end of the track. It is also conceivable to leave the control rail 24 open at the points since this too will be detected by the control device 18. However, to utilize the entire length of track 10, the control rail 24 can be artificially lengthened by inserting appropriate elements, for example a resistor, so that vehicles travelling towards the end of the track come to a standstill in front, or at the end, of the track.

In order to permit vehicles to travel in both directions on one track, the diode blocks can have a diode unit connected to the neutral rail between two sections on each side of the diode elements. The diode unit, viewed in the conducting direction of the diode elements, is connected downstream of the diode elements. The diode unit includes a diode, with a conducting direction from the diode element towards the neutral rail, connected in series to a Zener diode. The Zener diode is connected between this diode and the neutral rail with opposite polarity. In the respective other diode unit, the diode and Zener diode are connected in series with reversed conducting direction.

In this embodiment, a changeover device is provided on the vehicle in order to connect the positive pole of the voltage source to the control rail and the negative pole to the neutral rail when travelling in the conducting direction of the diode elements, and to invert these connections when travelling in the opposite direction. The change-over device also short-circuits the pick-up shoes which are at the rear in the respective direction of travel and connects the respective front pick-up shoes with appropriate polarity to the voltage source.

While the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

What is claimed is:

1. A system for automatically controlling the distance between vehicles following each other on a drive track, the system including a neutral rail and a control rail both paralleling the drive track, each vehicle in the system comprising:

drive means for driving the vehicle at a speed based on a speed control signal;

brake means for emergency braking the vehicle;

distance sensing means for generating a distance signal corresponding to a distance to an immediately preceding vehicle on the drive track;

vehicle speed measuring means for measuring a speed of the vehicle and for generating a plurality of speed signals based thereon;

means for generating a maximum permissible speed signal based on the distance signal; and control means for generating the speed control signal based on the distance signal, the speed control signal controlling the drive means at a speed which is lower than said maximum permissible speed signal, and the control means for controlling the brake means to emergency brake the vehicle when at least one of the plurality of speed signals are greater than the maximum permissible speed signal.

2. The system of claim 1, wherein the control means comprises:

first and second mutually independent control unit means for independently comparing at least one of the plurality of speed signals to the maximum permissible speed signal and for independently controlling the brake means to emergency brake the vehicle when at least one of the plurality of speed signals are greater than the maximum permissible speed signal.

3. The system of claim 1, wherein the control means includes a voltage source having poles electrically connected to the control rail and the neutral rail via the distance sensing means.

4. The system of claim 3, wherein:

the control rail is divided into mutually insulated sections, the sections having a length less than a distance between the distance sensing means and a rear sensing means of said vehicle; and a plurality of diode blocks arranged between adjacent control rail sections, each diode block being arranged in a same conducting direction.

5. The system of claim 4, wherein:

the diode blocks are aligned in a direction of vehicle travel; and each diode block includes a zener diode connected in series with a resistor between each control rail section and the neutral rail.

6. The system of claim 5, wherein each diode block further includes at least two parallel connections of a diode and a resistor connected in series.

7. The system of claim 3, wherein the control rail and the neutral rail are short-circuited when a set of points is open, and at an end of the drive track.

8. The system of claim 1, further comprising fault detecting means for controlling the brake means to emergency brake the vehicle when a fault which prevents automatic distance control occurs.

9. The system of claim 1, wherein the control means controls the brake means to emergency brake the vehicle when at least one of the plurality of speed signals are greater than the distance signal.

10. The system of claim 1, wherein the control means comprises at least a first and a second mutually independent control unit means for independently comparing at least one of the plurality of speed signals to the distance signal and for independently controlling the brake means to emergency brake the vehicle when at least one of the plurality of speed signals are greater than the distance signal.

11. A system for automatically controlling a distance between vehicles following each other on a drive track, the system including a neutral rail and a control rail both paralleling the drive track, each vehicle in the system comprising:

drive means for driving the vehicle at a speed based on a speed control signal;

brake means for braking the vehicle;

distance sensing means for generating a distance signal corresponding to a distance to an immediately preceding vehicle on the drive track;

vehicle speed measuring means for measuring a speed of the vehicle and for generating a plurality of speed signals based thereon, said vehicle speed measuring means including two mutually independent speed sensing means for independently sensing the vehicle speed and for generating a first speed signal and a second speed signal, respectively;

means for generating a maximum permissible speed signal based on the distance signal; and control means for generating the speed control signal based on the distance signal, the speed control signal controlling the drive means at a speed which is lower than said maximum permissible speed signal, and the control means for controlling the brake means to brake the vehicle when at least one of the plurality of speed signals are greater than the maximum permissible speed signal, the control means comprising:

first and second mutually independent control unit means, for independently comparing the first speed signal and the second speed signal to the maximum permissible speed signal, for independently controlling the brake means to brake the vehicle when at least one of the plurality of speed signals are greater than the maximum permissible speed signal, for controlling the braking means to brake the vehicle when the first and the second speed signal differ by a first predetermined speed tolerance value, and for controlling the braking means to brake the vehicle when the first and the second speed signal indicate that the vehicle is travelling in a wrong direction.

12. The system of claim 11, wherein the first control unit means generates a third speed signal corresponding to the first speed signal when a difference between the first and the second speed signal is less than or equal to the first predetermined speed tolerance value;

the second control unit means generates a fourth speed signal corresponding to the second speed signal when the difference between the first and the second speed signal is less than or equal to the first predetermined speed tolerance value; and the control means further includes a comparator means for comparing the third speed signal and the fourth speed signal and for controlling the braking means to brake the vehicle when the third speed signal and the fourth speed signal differ by greater than a second predetermined speed tolerance value.

13. The system of claim 12, wherein:

the comparator means generates a fifth speed signal corresponding to the first and the second speed signal when a difference between the third and the fourth speed signal is less than or equal to the second predetermined speed tolerance value; and the control means includes drive control means for generating the speed control signal based on the distance control signal.

14. A system for automatically controlling a distance between vehicles following each other on a drive track, the system including a neutral rail and a control rail both paralleling the drive track, each vehicle in the system comprising:

drive means for driving the vehicle at a speed based on a speed control signal;

brake means for braking the vehicle;

distance sensing means for generating a distance signal corresponding to a distance to an immediately preceding vehicle on the drive track;

vehicle speed measuring means for measuring a speed of the vehicle and for generating a plurality of speed signals based thereon;

means for generating a maximum permissible speed signal based on the distance signal;

control means for generating the speed control signal based on the distance signal, the speed control signal controlling the drive means at a speed which is lower than said maximum permissible speed signal, and the control means for controlling the brake means to brake the vehicle when at least one of the plurality of speed signals are greater than the maximum permissible speed signal, the control means comprising:

first and second mutually independent control unit means for independently comparing the first speed signal and the second speed signal to the maximum permissible speed signal, for independently controlling the brake means to brake the vehicle when at least one of the plurality of speed signals are greater than the maximum permissible speed signal, the first control unit means for generating a first corresponding distance signal corresponding to the distance signal, the second control unit means for generating a second corresponding distance signal corresponding to the distance signal, and comparator means for comparing the first and the second corresponding distance signals and for controlling the braking means to brake the vehicle when the first and the second corresponding distance signals differ by greater than a predetermined distance tolerance value.

15. The system of claim 14, wherein:

the comparator means generates a third corresponding distance signal corresponding to the distance signal and a fifth speed signal corresponding to the first and the second speed signal when a difference between the first and the second corresponding distance signal is less than or equal to the predetermined distance tolerance value and the difference between the third and the fourth speed signal is less than or equal to the second predetermined speed tolerance value; and the control means includes drive control means for generating the speed control signal based on the third corresponding distance control signal.

16. A system for automatically controlling the distance between vehicles following each other on a drive track, the system including a neutral rail and a control rail both paralleling the drive track, each vehicle in the system comprising:

drive means for driving the vehicle at a speed based on a speed control signal;

brake means for braking the vehicle;

distance sensing means for generating a distance signal corresponding to a distance to an immediately preceding vehicle on the drive track;

vehicle speed measuring means for measuring a speed of the vehicle and for generating a plurality of speed signals based thereon;

means for generating a maximum permissible speed signal based on the distance signal;

control means for generating the speed control signal based on the distance signal, the speed control signal controlling the drive means at a speed which is lower than said maximum permissible speed signal, and the control means for controlling the brake means to brake the vehicle when at least one of the plurality of speed signals are greater than the maximum permissible speed signal, the control means including:

a voltage source having poles electrically connected to the control rail and the neutral rail via the distance sensing means, first and second mutually independent voltage monitoring means for monitoring the voltage source and for generating first and second status signals, respectively, and comparator means for comparing the first and the second status signal and for controlling the brake means to brake the vehicle when the first and the second status signal differ by greater than a predetermined status tolerance value.

17. The system of claim 16, further comprising:

rear sensing means for electrically connecting the neutral rail to the control rail; and the distance sensing means is electrically connected to the control rail and the neutral rail.

18. The system of claim 17, wherein:

the control rail is divided into mutually insulated sections, each control rail section having a length less than a distance between the distance sensing means and the rear sensing means of a vehicle; and a plurality of diode blocks arranged between adjacent control rail sections, each diode block being arranged in a same conducting direction.

19. The system of claim 18, wherein:

the diode blocks are aligned in a direction of vehicle travel; and each diode block includes a zener diode connected in series with a resistor between each control rail section and the neutral rail.

20. The system of claim 19, wherein each diode block further includes at least two parallel connections of a diode and a resistor connected in series.

* * * * *